US009094757B2

(12) United States Patent
Blonder et al.

(10) Patent No.: US 9,094,757 B2
(45) Date of Patent: Jul. 28, 2015

(54) HEADPHONE APPARATUS WITH CORD STORAGE

(71) Applicants: Gregory Blonder, Summit, NJ (US); Dan DeLaRosa, Coral Springs, FL (US)

(72) Inventors: Gregory Blonder, Summit, NJ (US); Dan DeLaRosa, Coral Springs, FL (US)

(73) Assignee: IdeaVillage Products Corp.

( * ) Notice: Subject to any disclaimer, the term of this patent is extended or adjusted under 35 U.S.C. 154(b) by 0 days.

(21) Appl. No.: 14/121,969

(22) Filed: Nov. 7, 2014

(65) Prior Publication Data

US 2015/0131839 A1 May 14, 2015

Related U.S. Application Data

(60) Provisional application No. 61/962,584, filed on Nov. 12, 2013.

(51) Int. Cl.
*H04R 25/00* (2006.01)
*H04R 1/10* (2006.01)

(52) U.S. Cl.
CPC ..... *H04R 1/1033* (2013.01)

(58) Field of Classification Search
CPC .. H04R 1/1008; H04R 1/1016; H04R 1/1033; H04R 1/1066; H04R 5/033; H04R 5/0335
USPC ..... 381/370, 374, 376–379, 383
See application file for complete search history.

(56) References Cited

U.S. PATENT DOCUMENTS

| | | | | |
|---|---|---|---|---|
| 4,499,593 | A * | 2/1985 | Antle | 381/378 |
| 6,654,966 | B2 * | 12/2003 | Rolla | 381/374 |
| 7,184,565 | B2 * | 2/2007 | Ohta | 381/384 |
| 2003/0169896 | A1 * | 9/2003 | Kirk et al. | 381/370 |

* cited by examiner

*Primary Examiner* — Brian Ensey
(74) *Attorney, Agent, or Firm* — Dan DelaRosa

(57) ABSTRACT

A headset apparatus is provided, the apparatus comprises: a headband; two speakers and a cord; the apparatus comprises grooves and/or channels for allowing the cord to be wrapped around the apparatus during a stowage position.

21 Claims, 4 Drawing Sheets

HEADPHONE APPARATUS WITH CORD STORAGE

RELATED APPLICATION

This application is related to U.S. Provisional Application Ser. No. 61/962,584 entitled "Headphone Apparatus with Cord Storage" which was filed on Nov. 12, 2013.

BACKGROUND OF THE INVENTION

1.Field of the Invention

This invention relates to a headphone apparatus with cord storage and more specifically, music headphones with grooves and channels for cord storage.

2. Summary of the Invention

In one embodiment, the present invention provides for a headphone apparatus comprising: a headband having a middle portion with opposing ends and two end portions, each of the end portions being pivotally attached to each of the opposing ends of the middle portion, each of the opposing ends of the middle portion having a groove; at least two speakers, each of the speakers is attached to each one of the end portions of the headband; and at least one cord is attached to the apparatus, and the grooves on the middle portion is exposed when the speakers are in a folded position, and the cord is designed to wrap around the headphones and at least a portion of the cord are situated within the grooves during a stowage position.

In yet another embodiment, the middle portion of the headband comprises at least one channel, a portion of the cord is situated within the channel when the cord is wrapped around the headphones during the stowage position. In still another embodiment, the middle portion of the headband comprises a top surface, and the channel is situated on the top surface of the headband. In still yet another embodiment, the channel leads and is connected to the grooves on the headband.

In a further embodiment, the cord comprises a plug. In another further embodiment, the headband comprises a device for clipping the plug of the cord to said headband. In still a further embodiment, the outside surface of the speaker comprises a channel, and at least a portion of the cord is designed to fit within the channel when the cord is wrapped around the apparatus.

In yet a further embodiment, a portion of the end portions of the headband comprises at least one channel, and at least a portion of the cord is designed to fit within the channel when the cord is wrapped around the apparatus. In still yet a further embodiment, at least one of the speakers comprises a device for clipping the plug of the cord to the headband.

In another embodiment, the present invention provides for a headphone apparatus comprising: a headband having a middle portion with opposing ends and two end portions, and each of said end portions is pivotally attached to each of the opposing ends of the middle portion, and each of the end portions having a groove; at least two speakers, each of the speakers is attached to each one of the end portions of the headband; and at least one cord attached to one of the apparatus, and the grooves on the end portions is exposed when the speakers are in a folded position, and the cord is designed to wrap around the headphones and at least a portion of the cord are situated within the grooves during a stowage position.

In yet another embodiment, the middle portion of the headband comprises at least one channel, and a portion of the cord is situated within the channel when the cord is wrapped around the headphones during the stowage position. In still another embodiment, the middle portion of the headband comprises a top surface, and the channel is situated on the top surface of the headband.

In still yet another embodiment, the present invention relates to a headphone apparatus comprising: a headband having a middle portion with opposing ends and two end portions, and each of the end portions is pivotally attached to each of the opposing ends of the middle portion, and the middle portion comprising a channel; at least two speakers, each of the speakers is attached to each one of the end portions of the headband; and at least one cord attached to one of the speakers, and the grooves on the end portions is exposed when the speakers are in a folded position, and the cord is designed to wrap around the headphones and at least a portion of the cord are situated within the channel on the headband during a stowage position.

BRIEF DESCRIPTION OF THE DRAWINGS

The accompanying drawings are included to provide a further understanding of the present invention. These drawings are incorporated in and constitute a part of this specification, illustrate one or more embodiments of the present invention and together with the description, serve to explain the principles of the present invention.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention that may be embodied in various forms. The figures are not necessarily to scale, some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Figure 1:
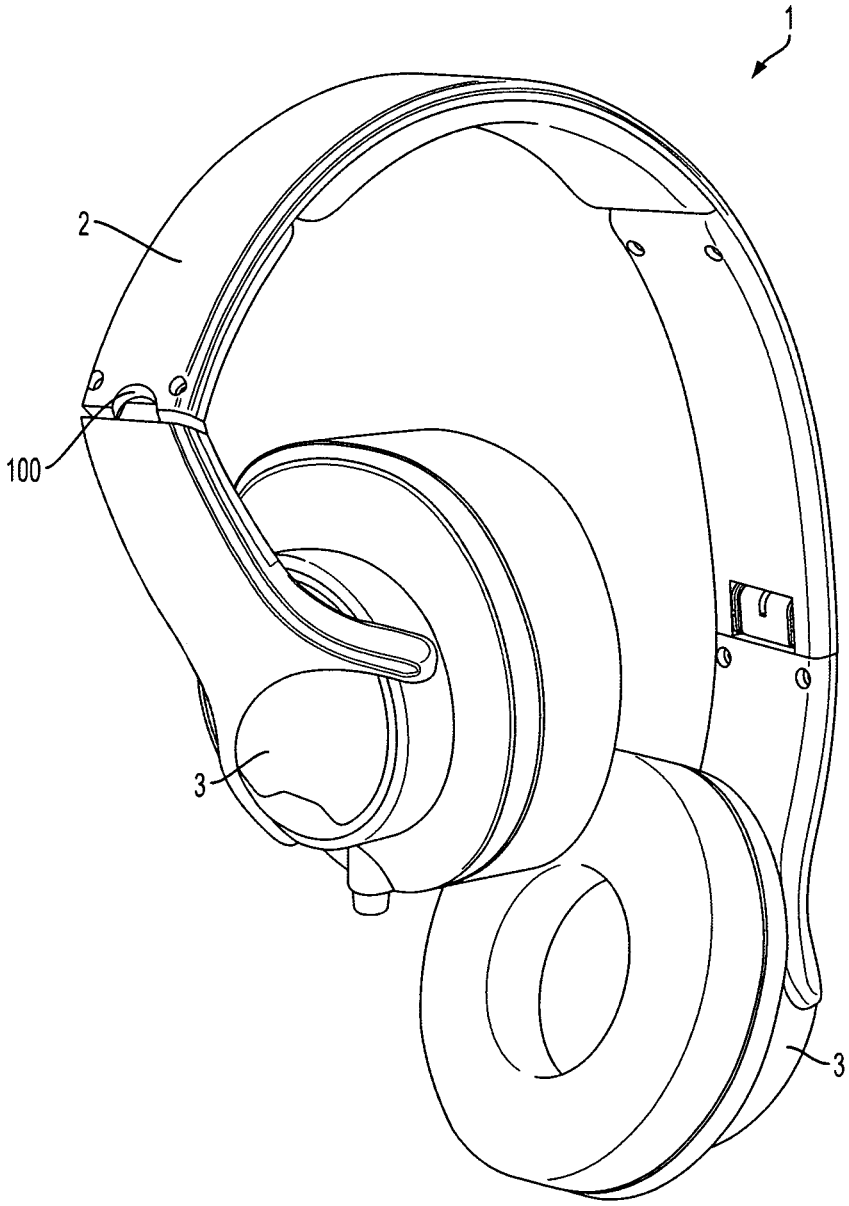
FIG. 1 is a perspective view of the apparatus of the present invention in a folded position showing the grooves.
Figure 4:
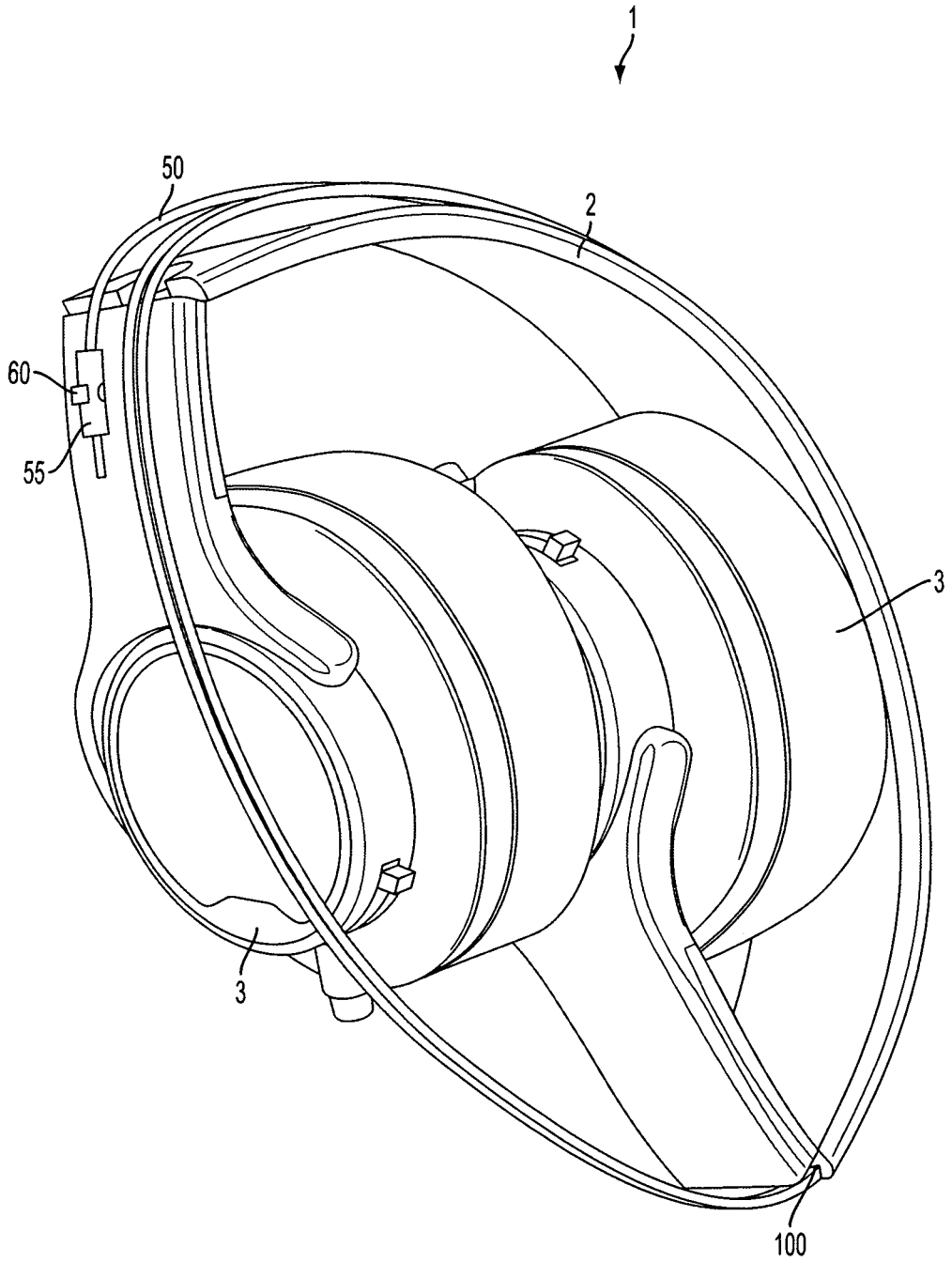
FIG. 4 is a perspective view of the cord wrapped around the headphones.

FIGS. 1 and 4 shows a headphone apparatus 1 comprising: a headband 2 having a middle portion with opposing ends and two end portions, each of the end portions being pivotally attached to each of the opposing ends of the middle portion, each of the opposing ends of the middle portion having a groove 100; at least two speakers 3, each of the speakers 3 is attached to each one of the end portions of the headband 2; and at least one cord 50 is attached to the apparatus, and the grooves on the middle portion is exposed when the speakers are in a folded position, and the cord 50 is designed to wrap around the headphones 1 and at least a portion of the cord 50 are situated within the grooves during a stowage position.

Figure 2:
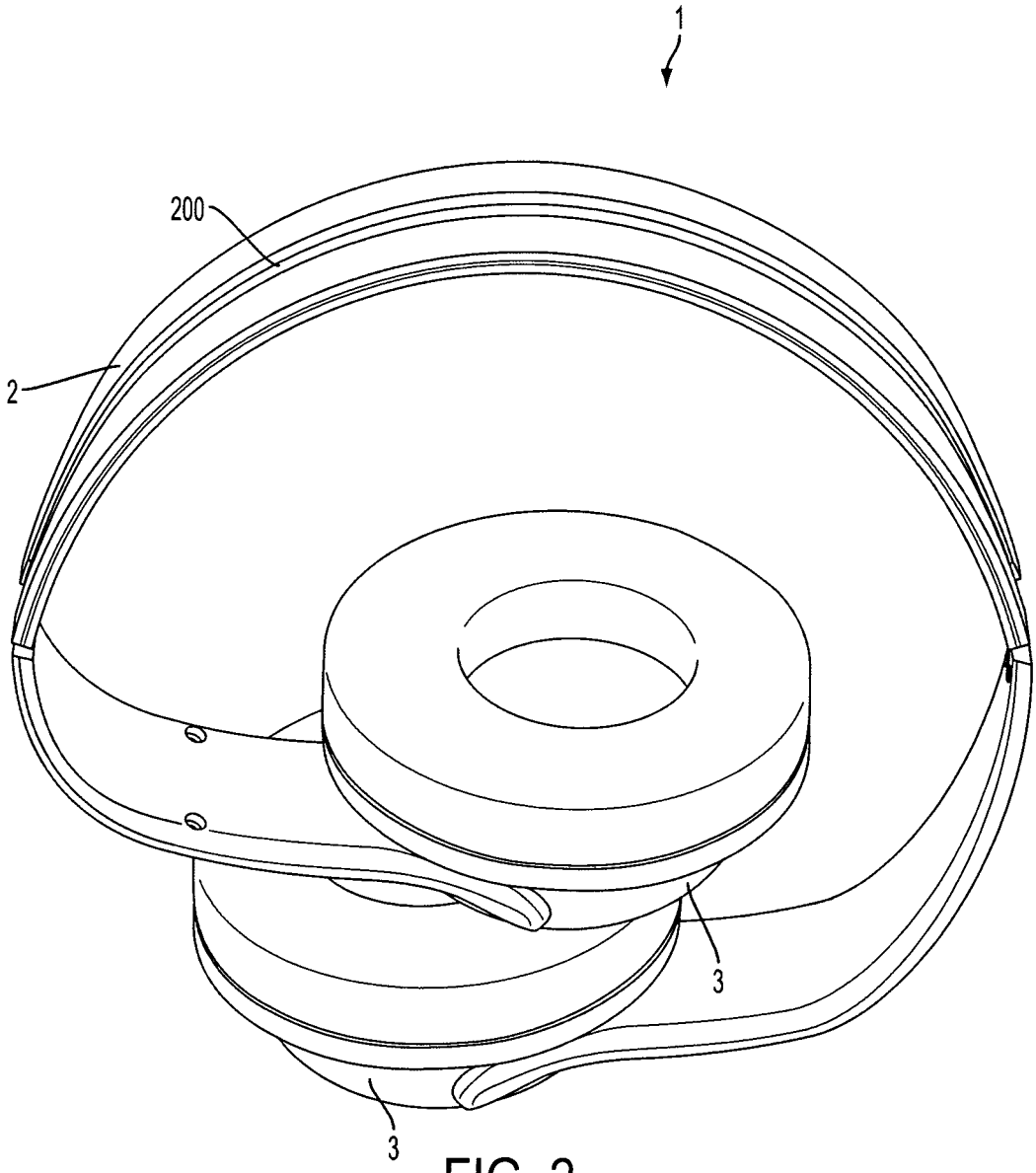
FIG. 2 is a perspective view of another embodiment showing the channel on the headband.

FIG. 2 shows the middle portion of the headband 2 comprises at least one channel 200, a portion of the cord 50 is designed to be situated within the channel 200 when the cord 50 is wrapped around the headphones 1 during the stowage position.

Figure 3:
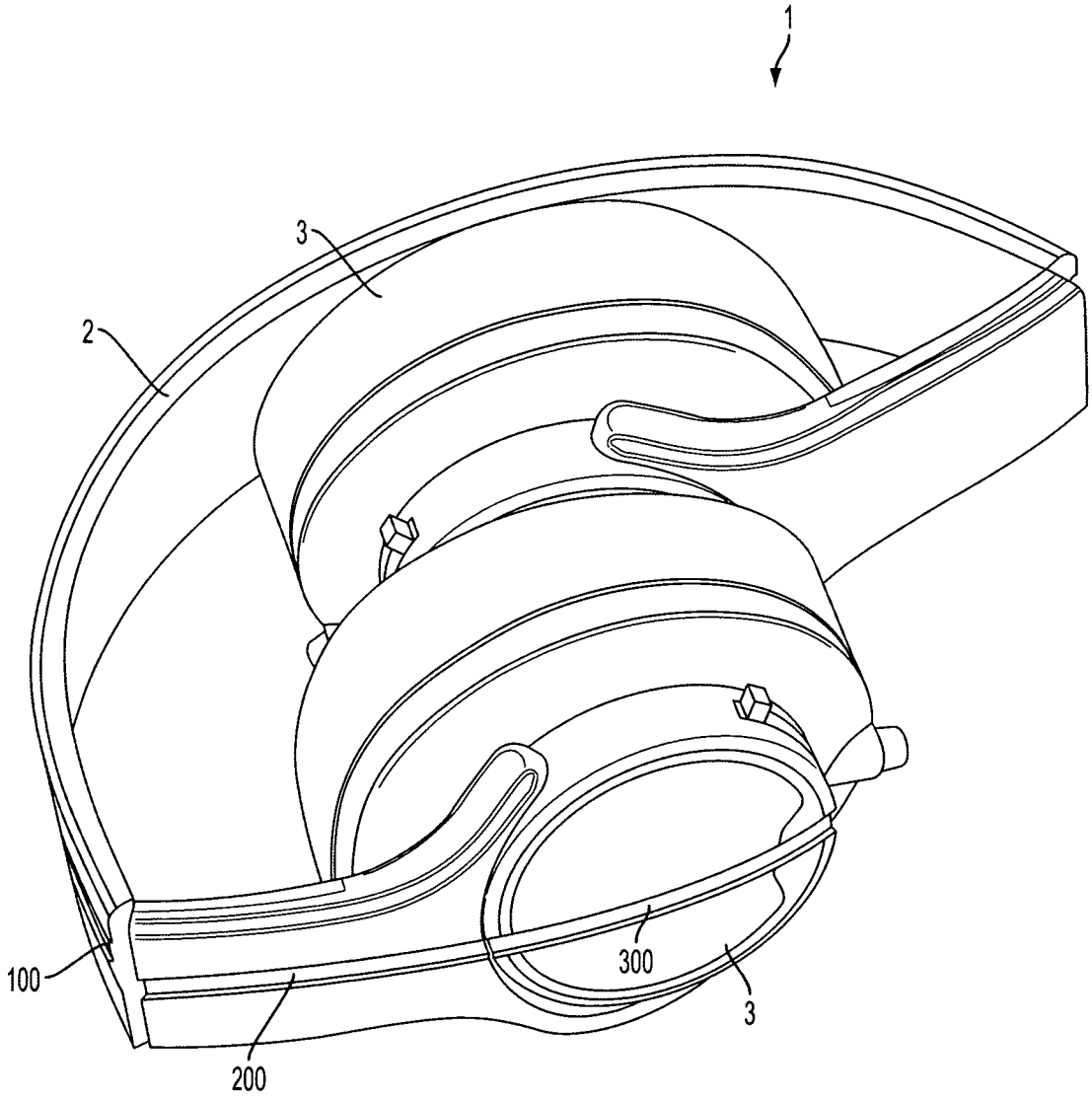
FIG. 3 is a perspective view of another embodiment showing the channel on the external surface of the speakers.

FIG. 3 illustrates the outside surface of the speaker 3 comprises a channel 300, and at least a portion of the cord 50 is designed to fit within the channel 300 when the cord 50 is wrapped around the apparatus.

FIG. 4 shows the headband 2 comprises a device 60 for clipping the plug 55 of the cord 50 to the headband.

Numerous modifications and variations of the present invention are possible in light of the above teachings. It is therefore to be understood that within the scope of the attendant claims attached hereto, this invention may be practiced otherwise than as specifically disclosed herein.

What is claimed is:

1. A headphone apparatus comprising:

a headband having a middle portion with opposing ends and two end portions, each of said end portions being pivotally attached to each of said opposing ends of said middle portion, each of said opposing ends of said middle portion having a groove;

at least two speakers, each of said speakers being attached to each one of said end portions of said headband; and at least one cord is attached to said apparatus, said grooves on said middle portion being exposed when said speakers are in a folded position, said cord is designed to wrap around said headphones and at least a portion of said cord are situated within said grooves during a stowage position.

2. The apparatus of claim 1 wherein said middle portion of said headband comprises at least one channel, a portion of said cord is situated within said channel when said cord is wrapped around said headphones during said stowage position.

3. The apparatus of claim 2 wherein said middle portion of said headband comprises a top surface, said channel is situated on said top surface of said headband.

4. The apparatus of claim 2 wherein said channel leads and is connected to said grooves on said headband.

5. The apparatus of claim 1 wherein said cord comprises a plug.

6. The apparatus of claim 5 wherein said headband comprises a device for clipping said plug of said cord to said headband.

7. The apparatus of claim 1 wherein an outside surface of said speaker comprises a channel, at least a portion of said cord is designed to fit within said channel when said cord is wrapped around said apparatus.

8. The apparatus of claim 1 wherein a portion of said end portions of said headband comprises at least one channel, at least a portion of said cord is designed to fit within said channel when said cord is wrapped around said apparatus.

9. The apparatus of claim 5 wherein at least one of said speakers comprises a device for clipping said plug of said cord to said headband.

10. A headphone apparatus comprising:

a headband having a middle portion with opposing ends and two end portions, each of said end portions being pivotally attached to each of said opposing ends of said middle portion, each of said end portions having a groove;

at least two speakers, each of said speakers being attached to each one of said end portions of said headband; and at least one cord attached to one of said apparatus, said grooves on said end portions being exposed when said speakers are in a folded position, said cord is designed to wrap around said headphones and at least a portion of said cord are situated within said grooves during a stowage position.

11. The apparatus of claim 10 wherein said middle portion of said headband comprises at least one channel, a portion of said cord is situated within said channel when said cord is wrapped around said headphones during said stowage position.

12. The apparatus of claim 11 wherein said middle portion of said headband comprises a top surface, said channel is situated on said top surface of said headband.

13. The apparatus of claim 11 wherein said cord comprises a plug.

14. The apparatus of claim 13 wherein said headband comprises device for clipping said plug to said headband.

15. The apparatus of claim 11 wherein an outside surface of said speaker comprises a channel, at least a portion of said cord is designed to fit within said channel when said cord is wrapped around said apparatus.

16. The apparatus of claim 11 wherein a portion of said end portions of said headband comprises at least one channel, at least a portion of said cord is designed to fit within said channel when said cord is wrapped around said apparatus.

17. The apparatus of claim 13 wherein at least one of said speakers comprises a device for clipping said plug of said cord to said headband.

18. A headphone apparatus comprising:

a headband having a middle portion with opposing ends and two end portions, each of said end portions being pivotally attached to each of said opposing ends of said middle portion, said middle portion comprising a channel;

at least two speakers, each of said speakers being attached to each one of said end portions of said headband; and at least one cord attached to one of said speakers, said grooves on said end portions being exposed when said speakers are in a folded position, said cord is designed to wrap around said headphones and at least a portion of said cord are situated within said channel on said headband during a stowage position.

19. The apparatus of claim 18 wherein a portion of said end portions of said headband comprises at least one channel, at least a portion of said cord is designed to fit within said channel when said cord is wrapped around said apparatus.

20. The apparatus of claim 18 wherein said cord comprises a plug, said apparatus comprises a device for clipping said plug of said cord to said apparatus.

21. The apparatus of claim 18 wherein an outside surface of said speaker comprises a channel, at least a portion of said cord is designed to fit within said channel when said cord is wrapped around said apparatus.

* * * * *